United States Patent [19]

Myers

[11] 3,968,731

[45] July 13, 1976

[54] FLUID MOTOR FOR SWINGING BOOMS

[75] Inventor: Jimmy Dale Myers, Morton, Ill.

[73] Assignee: Caterpillar Tractor Co., Peoria, Ill.

[22] Filed: Mar. 6, 1975

[21] Appl. No.: 555,925

[52] U.S. Cl. ..... 91/407; 91/31; 92/79; 92/125

[51] Int. Cl.[2] ..... F15B 21/04; F15B 15/22; F01C 9/00

[58] Field of Search ..... 91/408, 407, 26, 31; 92/121, 122, 123, 124, 125, 79

[56] References Cited

UNITED STATES PATENTS

| | | | |
|---|---|---|---|
| 2,489,326 | 11/1949 | Rockstrom et al. | 92/124 |
| 2,798,462 | 7/1957 | Ludwig et al. | 92/125 |
| 2,902,009 | 9/1959 | Ludwig et al. | 91/408 |
| 3,120,897 | 2/1964 | Auwelaer et al. | 214/138 |
| 3,174,635 | 3/1965 | Auwelaer et al. | 214/138 |
| 3,207,048 | 9/1965 | Rumsey | 91/408 |
| 3,267,815 | 8/1966 | Ortman et al. | 91/408 |

*Primary Examiner*—Paul E. Maslousky
*Attorney, Agent, or Firm*—Wegner, Stellman, McCord, Wiles & Wood

[57] ABSTRACT

A fluid motor for a backhoe or the like. A hollow motor cylinder is provided with upper and lower end plates to define a motor chamber through which a generally vertical shaft extends. The shaft is journalled for relative rotation and a first vane is located within the motor chamber and is secured to the shaft and sealingly engages the cylinder and the end plates. A second vane is located within the motor chamber and is secured to the cylinder and sealingly engages the shaft. Ports of a first set are interconnected for continual fluid flow between each other and open into the chamber adjacent one side of the second vane and include at least one port in each of the end plates. Ports of a second set are interconnected to each other and open into the chamber adjacent the other side of the second vane and include at least one port in each of the end plates. As a consequence, sediment in a hydraulic system may be discharged from the motor through the lower ports, while air or other gases in the system may be purged from the motor through the upper ports.

4 Claims, 4 Drawing Figures

Fig. 2
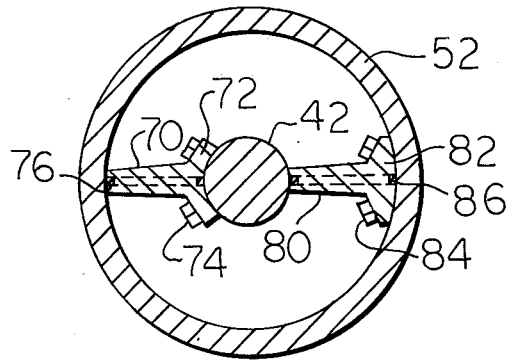
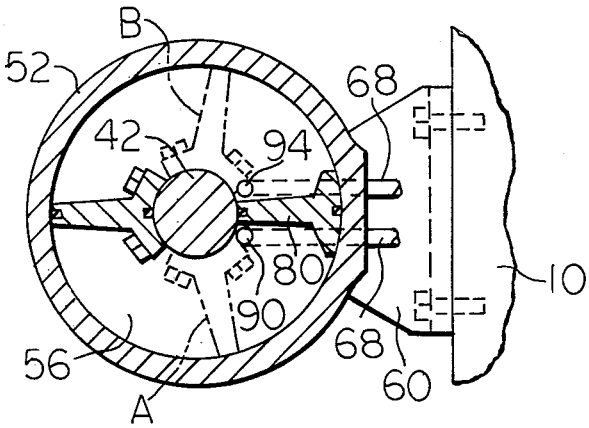
Fig. 3
Fig. 4
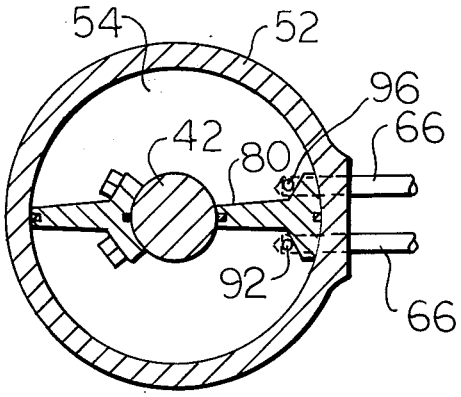

FLUID MOTOR FOR SWINGING BOOMS

BACKGROUND OF THE INVENTION

This invention relates to fluid motors, and, more particularly, to fluid motors for backhoes or the like. More specifically, it relates to an improved porting system for such a motor.

Prior art of possible relevance includes the following U.S. Pat. Nos. Rockstrom et al 2,489,326, issued Nov. 29, 1949; Ludwig et al 2,798,462, issued July 9, 1957; Van Auwelaer et al 3,120,897, issued Feb. 11, 1964; and Van Auwelear et al 3,174,635, issued Mar. 23, 1965.

Rotary fluid motors are increasingly being used for rotationally positioning or swinging backhoes or the like for the reason that such motors are compact. While such motors are effective and widely used, operational problems occur due to particular characteristics of the design of the motors and their control systems. In typical prior art structures, the working fluid, normally a hydraulic fluid, is introduced into the motor chamber from either the top or the bottom, but not both. The specific location of supply lines to such ports pose the operational difficulties alluded to previously.

Elevated supply lines serve to purge air to relieve air pockets in the system that result in spongy hydraulic action. However, such lines allow foreign particles typically present in the system to settle and accumulate. As a consequence, some abrasive action against motor seals will occur, thereby lessening the useful life of the motor.

Suppiy lines to lower motor portions frequently fail to properly vent air or other gases from the hydraulic fluid, with the result that spongy, non-positive hydraulic action occurs.

SUMMARY OF THE INVENTION

It is the principal object of the invention to provide a new and improved rotary motor for a backhoe or the like. More specifically, it is an object of the invention to provide such a motor with an improved porting system to avoid the accumulation of sediment in such a fluid motor and yet insure venting of air to avoid non-positive hydraulic action.

The exemplary embodiment of the invention achieves the foregoing object in a construction including a hollow cylinder disposed concentrically about a generally vertical shaft. Upper and lower end plates are secured to and sealingly engage opposite ends of the cylinder to define the motor chamber. A first vane within the motor chamber is secured to the shaft and sealingly engages the cylinder and the end plates. A second vane within the motor chamber is secured to at least one of the cylinder and the end plates and sealingly engages the shaft.

A first set of ports is provided to open into the chamber adjacent one side of the second vane. This set of ports includes at least one port in each of the end plates. A fluid flow path that is continually open is established between the ports of the first set.

A second set of ports is provided to open into the chamber adjacent the other side of the second vane, with the second set including at least one port in each of the end plates. Again, a continually open fluid flow path extends between the ports of the second set. As a consequence, air or entrained gases may be vented from the motor chamber through the upper ports in each set while sediment in the motor may be exhaused therefrom through the lower ports in each set.

In a highly preferred embodiment, at least one port in each set is a main port located to be at least partially closed by the first vane when the first vane is adjacent the corresponding side of the second vane. The other port of each set is provided with a fluid flow restricting means. As a consequence, when the first vane approaches the second vane signifying the approaching of the end of its permissible path of travel, the main port will be closed off and fluid will continue to be directed into the chamber through the other port having the fluid flow restricting means at a reduced rate to provide cushioning at the end of the path of travel.

Preferably, the main ports are located adjacent the shaft, while the other ports are located radially outwardly of the main ports. Moreover, it is preferable that the main ports be located in the lower end plate. As a consequence of such a construction, the greater fluid volume entering the chamber through a given one of the lower ports will tend to "stir up" any sediment within the chamber to cause the same to be suspended in the working fluid. Once the working fluid has been removed from the chamber through normal operation of the motor, it may be removed entirely through the use of a suitable filter.

Other objects and advantages will become apparent from the following specification taken in connection with the accompanying drawings.

DESCRIPTION OF THE DRAWINGS

FIG. 2 is a horizontal section of the fluid motor taken approximately along the line 2—2 of FIG. 1;

FIG. 3 is a horizontal section of the fluid motor taken approximately along the line 3—3 of FIG. 1; and FIG. 4 is a horizontal section taken approximately along the line 4—4 of FIG. 1.

DESCRIPTION OF THE PREFERRED EMBODIMENT

Figure 1:
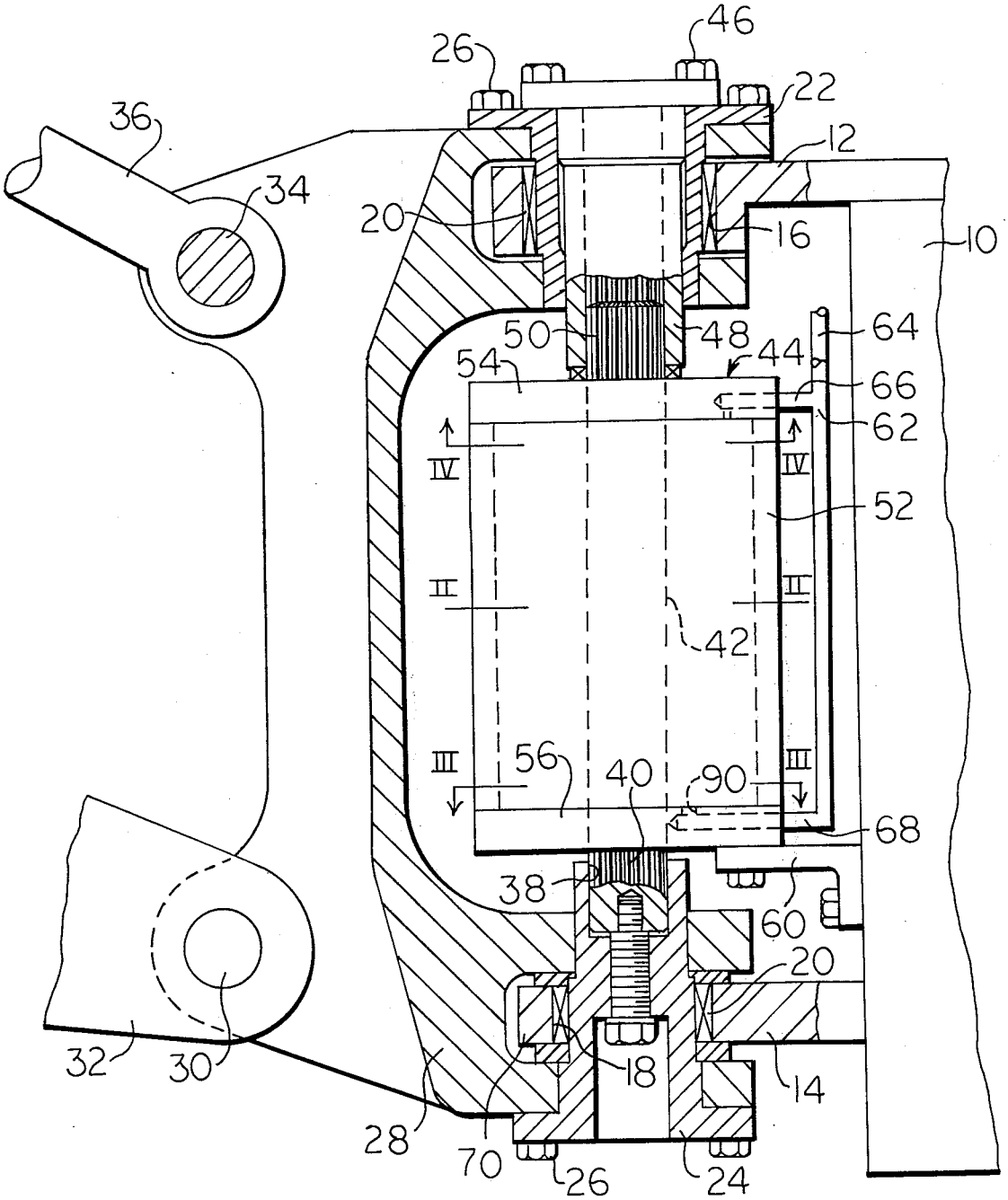
FIG. 1 is a fragmentary side elevation of a portion of a backhoe employing a fluid motor made according to the invention.

An exemplary embodiment of a fluid motor made according to the invention is illustrated in the drawings and, with reference specifically to FIg. 1, there is shown the rear end of a frame 10 of a vehicle such as a tractor or tracked vehicle employing the invention in connection with a backhoe. The frame 10 mounts upper and lower rearwardly extending yoke-like elements 12 and 14 which are provided with aligned apertures 16 and 18, respectively, for receipt of bearings 20. The bearings 20 journal shaft-like fixtures 22 and 24 which are secured by means of bolts 26 to corresponding arms of a yoke 28 forming part of a backhoe.

A lower pivot 30 journals one end of a boom arm 32 of the backhoe, while an upper pivot 34 journals the end 36 of a hydraulic piston rod which may be conventionally controlled to position the backhoe, including the boom 32, in a manner well known in the art.

The shaft-like fixture 24 includes an upwardly opening splined bore 38 for receipt of the lower splined end 40 of the shaft 42 of a vane motor 44. The shaft-like fixture 22 mounts, by means of bolts 46, a sleeve 48 having an internal splined surface splined to the upper splined end 50 of the shaft 42.

The motor 44 includes a hollow cylinder 52 disposed concentrically about the shaft 42 and upper and lower end plates 54 and 56, respectively. The lower end plate 56 is connected by means of a bracket 60 to the frame 10. As a consequence of the foregoing, actuation of the motor 44 will cause rotation of the shaft 42 to pivot, about a vertical axis, the backhoe. During such movement, the cylinder 52 is precluded from rotating by reason of the connection to the main frame 10 by the bracket 60. However, it is to be understood that, if desired, the backhoe could be secured to the cylinder 52 and the shaft 42 to the frame 10 to achieve the same result.

A pair of supply lines for hydraulic fluid under pressure is illustrated in FIG. 1 and designated 62 and 64, respectively. Each of the lines 62 and 64 has connections to ports in both the upper and lower end plates 54 and 56, respectively, by conduits 66 and 68, respectively.

Turning now to FIG. 2, which illustrates a horizontal section of the motor 44, within the motor chamber defined by the cylinder 52 and the end plates 54 and 56, there is located a first vane 70 having a base 72 disposed to embrace the shaft 42. By means of bolts 74, the base 72 and thus the vane 70, is secured to the shaft 42. Peripherally about the vane 70 and base 72, in a generally vertical plane, a suitable sealing element 76 is disposed. The sealing element 76 will, as a result, sealingly engage the interior of the cylinder 52 as well as both end plates 54 and 56 and the shaft 42.

A second vane 80 is also disposed within the cylinder 52 and includes a base 82 in abutment with the interior wall of the cylinder 52. Bolts 84 are employed to secure the second vane 80 to the cylinder 52. Like the vane 70, the vane 80 is provided with a peripheral seal 86 which sealingly engages the cylinder 52, the end plates 54 and 56 and the shaft 42.

As a consequence of the foregoing construction, it will be appreciated that the shaft 42 is rotatable within the motor chamber and that the vane 70 is rotatable therewith. At the same time, the vane 80 is firmly affixed to the cylinder 52. If fluid under pressure is applied to the area above the vane 70, as depicted in FIG. 2, and the area below the base 72 is connected to a fluid drain, the vane 70 will be rotated in a counterclockwise direction toward a position such as that shown in dotted lines and designated A in FIG. 3. If the application of fluid under pressure and draining is reversed, clockwise rotation of the vane 70 will occur such that the same may move to a position shown in dotted lines and designated B in FIG. 3. Such rotation will, of course, result in the shaft 42 being rotated in the same direction to thereby swing the backhoe.

Introduction of fluid under pressure and the removal of the same to drain will now be considered in detail. With reference to FIG. 3, one of the conduits 68 and, specifically, that connected to the line 62, is in fluid communication with the interior of the motor chamber via a port 90. The port 90 is a main port and is located in the lower end plate 56 immediately adjacent the second vane 80 and the shaft 42.

Turning now to FIG. 4, the conduit 66 associated with the line 62 is in fluid communication with the interior of the motor chamber via a port 92 located in the upper end plate 54 at a point adjacent the second vane 80 and radially outwardly of the shaft 42, and thus the port 90 on the same side of the second vane 80. The port 92 is an auxiliary port and, as can be seen from a comparison of FIGS. 3 and 4, is of somewhat smaller diameter than the port 90. As a consequence, fluid under pressure directed through the line 62 will flow into the motor chamber at a more rapid rate through the port 90 than through the port 92 by reason of the smaller size of the latter defining a fluid flow restricting means. However, it is to be observed that the ports 90 and 92 are in continuous fluid communication with each other and thereby define a first set of ports.

A second, somewhat similar set of ports, is also provided in connection with the line 64. Specifically, there is provided a large or main port 94 in the lower end plate 56 adjacent the opposite side of the second vane 80 and adjacent the shaft 42. A second port 96 of the second set, also in fluid communication with the line 64, is provided in the upper end plate 54. Again, the same is on the opposite side of the second vane 80 from the port 92 and is of restricted size.

It is also to be observed that the positioning of the ports 90 and 94 is such that they may be at least partially closed by the base 72 of the first vane 70 as the same rotates towards an extreme position of movement to either side of the second vane 80. The purpose of this structure or arrangement is as follows. As the first vane 70 moves to an extreme position of movement, it will close one or the other of the ports 90 and 94 through which the working fluid is being exhausted from the motor chamber to one or the other of the lines 62 or 64 which may be in fluid communication with a fluid drain. As a consequence, fluid may only exit the chamber through the other port in the pair, namely, the port 92 or the port 96. By reason of their restricted size, the rate of fluid flow will diminish to thereby slow movement of the first vane 70 near the end of its path of travel to provide a cushioning effect whereby the vane 70 will not contact the vane 80 with any appreciable force. Thus, prolonged life of the motor results.

While the larger ports 90 and 94 could be located in the upper end plate 54 rather than in the lower end plate 56 as shown, and the smaller ports 92 and 96 located in the lower end plate, the illustrated arrangement is preferred for the following reasons. Because of the larger size of the ports 90 and 94, when fluid is being introduced through either, a greater volume of fluid will enter the motor chamber through the ports 90 and 94 than through the other port in the set, namely port 92 or port 96. Since sediment will tend to accumulate on the lower end plate 54, the large volume flow through the ports 90 or 94 will "stir up" such sediment to keep the same in suspension within the working fluid. Moreover, when fluid is being exhausted through either the port 90 or the port 94, their relatively larger size provides substantial resistance to clogging by such sediment. Thus, the ports 90 and 94 preclude sediment deposition on the lower end plate where it could abrasively, detrimentally affect the seal 76 on the first vane 70.

It will also be appreciated that by locating the remaining ports in each set, namely, the ports 92 and 96, in the upper end plate, air or gas in the motor chamber can freely exit the same to be removed downstream by conventional equipment employed for the purpose.

From the foregoing, it will be appreciated that a fluid motor made according to the invention eliminates the problems of the prior art of detrimental sediment accumulation as well as spongy hydraulic action. It will also be appreciated that the construction is relatively simple in that numerous bores and valves heretofore required are eliminated while cushioning is nonetheless maintained.

I claim:

1. A fluid motor for a boom or the like, comprising:

a generally vertical shaft;

a hollow cylinder disposed concentrically about said shaft;

upper and lower end plates secured to and sealingly engaging opposite ends of said cylinder to define a motor chamber;

said motor chamber and said shaft being relatively rotatable;

a first vane within said motor chamber and secured to said shaft and sealingly engaging said cylinder and said end plates;

a second vane within said motor chamber and secured to at least one of said cylinder and said end plates and sealingly engaging said shaft;

a first set of ports opening into said chamber adjacent one side of said second vane, said first set including at least one port in each of said end plates;

first means establishing a continually open fluid flow path between the ports of said first set and adapted to be alternately connected to a fluid pressure source and a fluid drain;

a second set of ports opening into said chamber adjacent the other side of said second vane, said second set including at least one port in each of said end plates; and second means establishing a continually open fluid flow path between the ports of said second set and adapted to be alternately connected to the fluid pressure source and the fluid drain.

2. The fluid motor of claim 1 wherein one of the ports in each set is a main port located to be at least partially closed by said first vane when said first vane is adjacent the corresponding side of said second vane and wherein another port of each set is operatively associated with fluid flow restricting means.

3. The fluid motor of claim 2 wherein said main ports are located radially inwardly of said cylinder and adjacent said shaft, and said another ports are located radially outwardly of said main ports.

4. The fluid motor of claim 2 wherein said main ports are located in said lower end plate and said another ports are located in said upper end plate.

* * * * *